US006375193B1

(12) United States Patent
Yiu

(10) Patent No.: US 6,375,193 B1
(45) Date of Patent: Apr. 23, 2002

(54) DARTBOARD

(76) Inventor: Chih-Hao Yiu, Floor 7-1, No. 30, Lin-Sen Rd., Taichung City (TW)

( * ) Notice: Subject to any disclaimer, the term of this patent is extended or adjusted under 35 U.S.C. 154(b) by 0 days.

(21) Appl. No.: 09/411,086

(22) Filed: Oct. 4, 1999

(51) Int. Cl.[7] ..... F41J 5/052
(52) U.S. Cl. ..... 273/403; 273/408; 273/376
(58) Field of Search ..... 273/403, 404, 273/407, 408, 371, 374, 376

(56) References Cited

U.S. PATENT DOCUMENTS

| | | | | |
|---|---|---|---|---|
| 5,486,007 A | * | 1/1996 | Stewart et al. | 273/374 |
| 5,788,244 A | * | 8/1998 | Hui et al. | 273/374 |
| 6,047,968 A | * | 4/2000 | Lu et al. | 273/376 |
| 6,089,571 A | * | 7/2000 | Cho | 273/376 |

FOREIGN PATENT DOCUMENTS

| | | | | |
|---|---|---|---|---|
| GB | 981483 | * | 1/1965 | 273/408 |
| GB | 2247629 | * | 1/1965 | 273/408 |
| GB | 2273665 | * | 6/1994 | 273/408 |
| WO | 8002742 | * | 12/1980 | 273/408 |

* cited by examiner

*Primary Examiner*—Mark S. Graham

(57) ABSTRACT

A dartboard includes a heat-conductive frame and a heat-fusible block which is composed of a plurality of strips. The frame includes a board with a peripheral wall extending from the board. The heat-conductive frame is heated and cuts into the heat-fusible block to let a piece of the heat-fusible block enclosed by the frame. The piece of the heat-fusible block enclosed by the frame is separated into partitions by a plurality of separating ribs extending from the board and the peripheral wall.

3 Claims, 6 Drawing Sheets

DARTBOARD

FIELD OF THE INVENTION

The present invention relates to a dartboard, and more particularly, to a dartboard having a heat-conductive frame and the frame is heated and cuts a heat-fusible block to let a piece of the heat-fusible block be securely enclosed in the frame.

BACKGROUND OF THE INVENTION

A first embodiment of conventional dartboard is made of paperboards or straws so as to receive the darts having metal tips. The paperboards or straws are compressed to become a solid board so that when the metal tip hits the dartboard, the tip penetrates into the dartboard and is connected to the dartboard. However, when removing the dart from the dartboard, holes are defined in the surface of the dartboard. If a tip of another dart is inserted into one of the holes again, the dart will drop from the dartboard because there is no clamping force to clamp the tip. Furthermore, it is difficult to let the paperboards or straws be tightly enclosed in the frames which generally involve various of shapes. A second embodiment of the dartboard is made of plastic and includes a plurality of tiny chambers so that when the tip of a dart hits the plastic dartboard, the tip is securely engaged with one of the chambers. In other words, the tip of the dart is sized to be forced fitted into the chamber. Nevertheless, the plastic dartboard can only be used with the darts that have plastic tips. The plastic tips are not easily engaged with the chambers because of the less weight and the noise is large when the tip hits the plastic dartboard.

The present invention intends to provide a dartboard that includes a heat-conductive frame which is heated so as to cut into a heat-fusible block to let a piece of the heat-fusible block be enclosed in the frame. By the structure of the dartboard of the present invention, the dartboard is easily manufactured.

SUMMARY OF THE INVENTION

The present invention intends to provide a dartboard which comprise a heat-conductive frame having a board and a peripheral wall extends from the board so as to define a space. A heat-fusible block is composed of a plurality of strips which are bounded with each other. The heat-conductive frame is heated and cuts the heat-fusible block so that a piece of the heat-fusible block is enclosed in the frame.

The primary object of the present invention is to provide a dartboard that is easily manufactured simply by cutting the heat-fusible block with a heated frame to let a piece of the heat-fusible block be enclosed in the frame.

Another object of the present invention is to provide a dartboard wherein the heat-fusible block can be easily fitted into the score partitions of the frame with various shapes.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
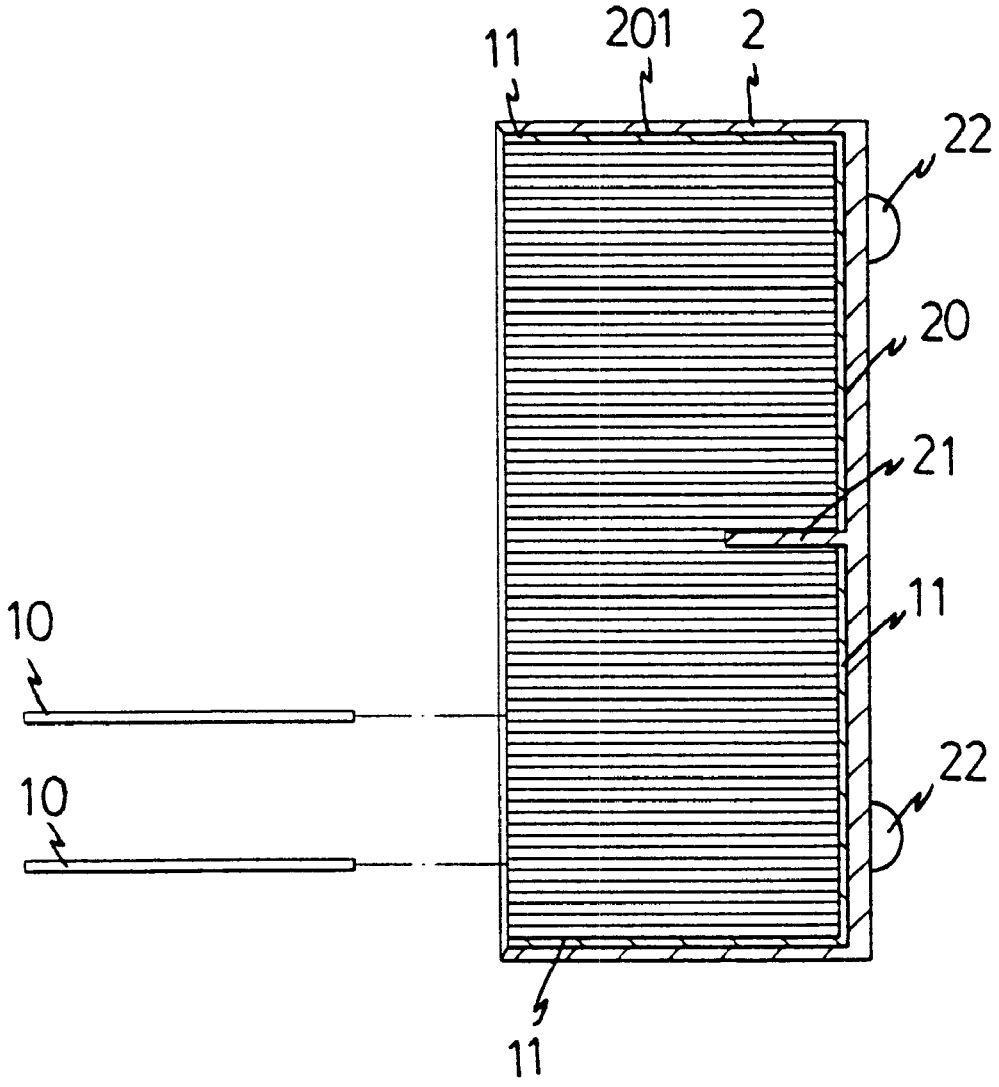
FIG. 1 is a side elevational view, partly in section, of the dartboard of the present invention and shows that the heat-fusible block is composed of a plurality of strips.
Figure 2:
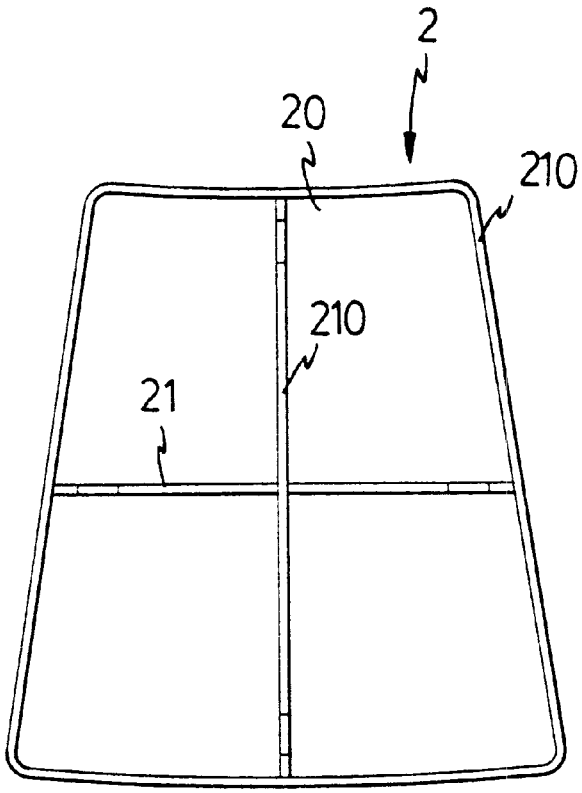
FIG. 2 is an illustrative view to show a front-plan view of the heat-conductive frame of the present invention.
Figure 3:
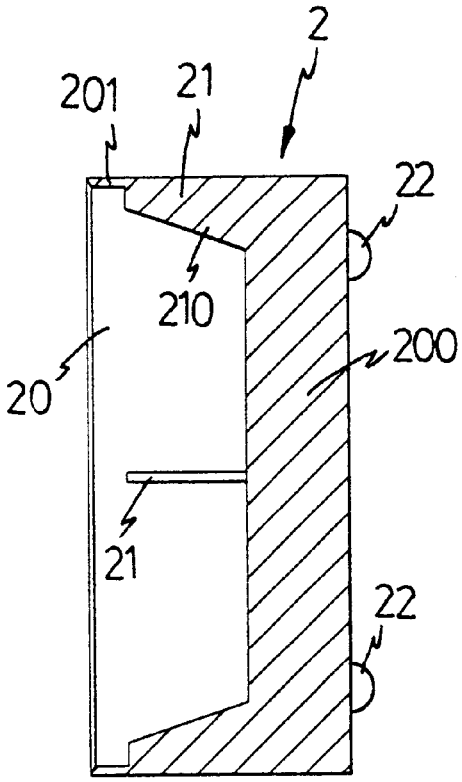
FIG. 3 is an illustrative view to show a cross-sectional view of the heat-conductive frame of the present invention.

Referring to FIGS. 1 to 4, the dartboard in accordance with the present invention comprises a heat-conductive frame 2 which is made of heat-conductive material for example, metal so that the frame can be heated. The frame 2 has a board 200 and a peripheral wall 201 extends from the board 200 so as to define a space between the board 200 and the peripheral wall 201. A plurality of separating ribs 21 respectively extend from the board 200 and the peripheral wall 201 so that the space is defined into several partitions. The separating ribs 21 each have a tapered surface 210 at the inside thereof. A heat-conductive layer 11 is attached to the inside of the frame 2 and the outside of the separating ribs 21 so that the layer 11 has a proper temperature.

A plurality of bosses 22 extend from the board 200 and a film 202 is located adjacent to the bosses 200. The film 202 is connected to a circuit board 7 which may have a CPU (not shown), a display unit (not shown) and a speaker 70 as known to the persons in the art. In other words, when the frame 2 is movable toward the circuit board 200, the bosses 22 contact the film 202 and the CPU is therefore actuated to illustrate information on the display unit.

A heat-fusible block 4 is composed of a plurality of strips 10 which are bounded together with each other to become a solid and high density block so that a metal tip of a dart 6 may penetrate the heat-fusible board 4 and will not drop.

Figure 4:
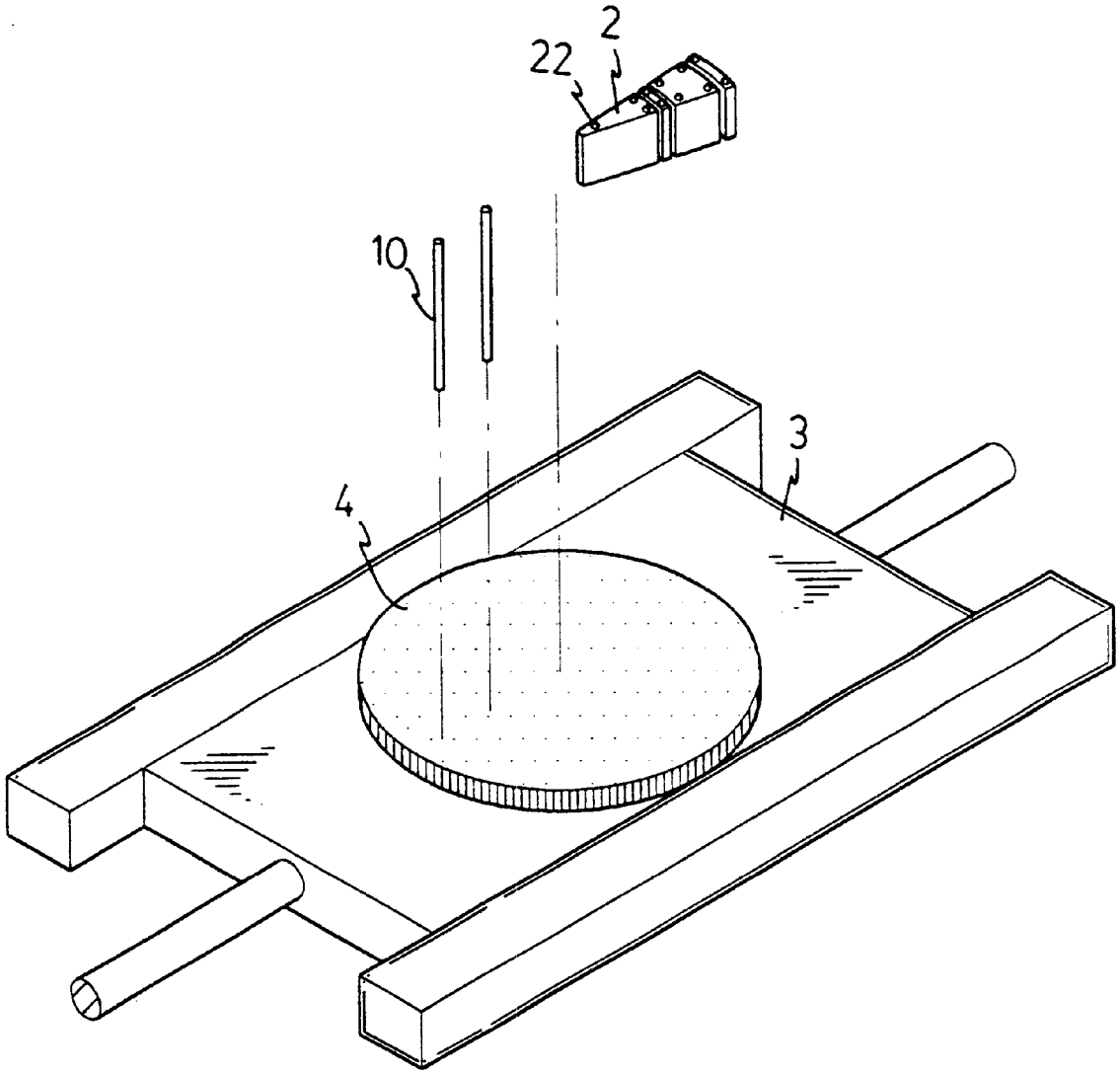
FIG. 4 is an exploded view to show that the frame is to cut into a heat-fusible block on a support member.

As shown in FIG. 4, the heat-conductive frame 2 can be made to be various shapes and the heat-fusible block 4 is put on a support member 3. The heat-conductive frame 2 is heated to have a proper temperature and cuts the heat-fusible block 4 so that the heat-conductive frame 2 with the proper temperature fuses the heat-fusible block 4 and a piece of the heat-fusible block 4 is enclosed in the frame 2. The piece of the heat-fusible block 4 is cut and fitted into the frame 2 according to the shape of the frame 2. Therefore, the frame 2 is allowed to be made complicated shape and the heat-fusible block 4 is still easily fitted into the frame 2.

Figure 5:
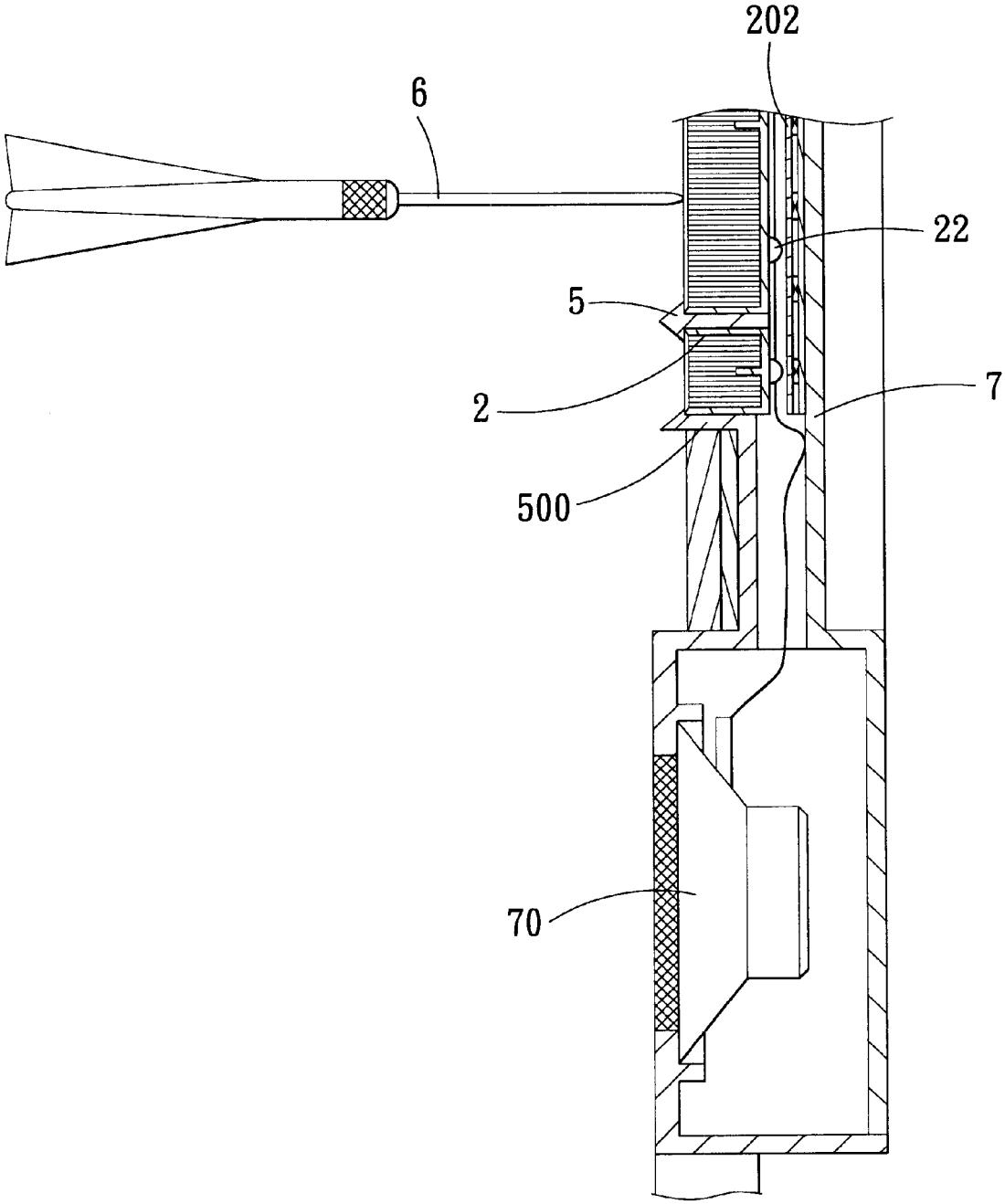
FIG. 5 is a side elevational view, partly in section, of the dartboard having electronic accessories connected thereto.

Referring to FIG. 5, the frames 2 are engaged with a space enclosed by the a main frame 500 and supporting frames 5 located in the space so that the frames 2 are separated by the supporting frames 5. When the dart 6 hits the dartboard, the frame 2 hit by the dart 6 is pushed and the bosses 22 contact the film 202 to actuate the electronic accessories to show the scores on the display unit.

Figure 6:
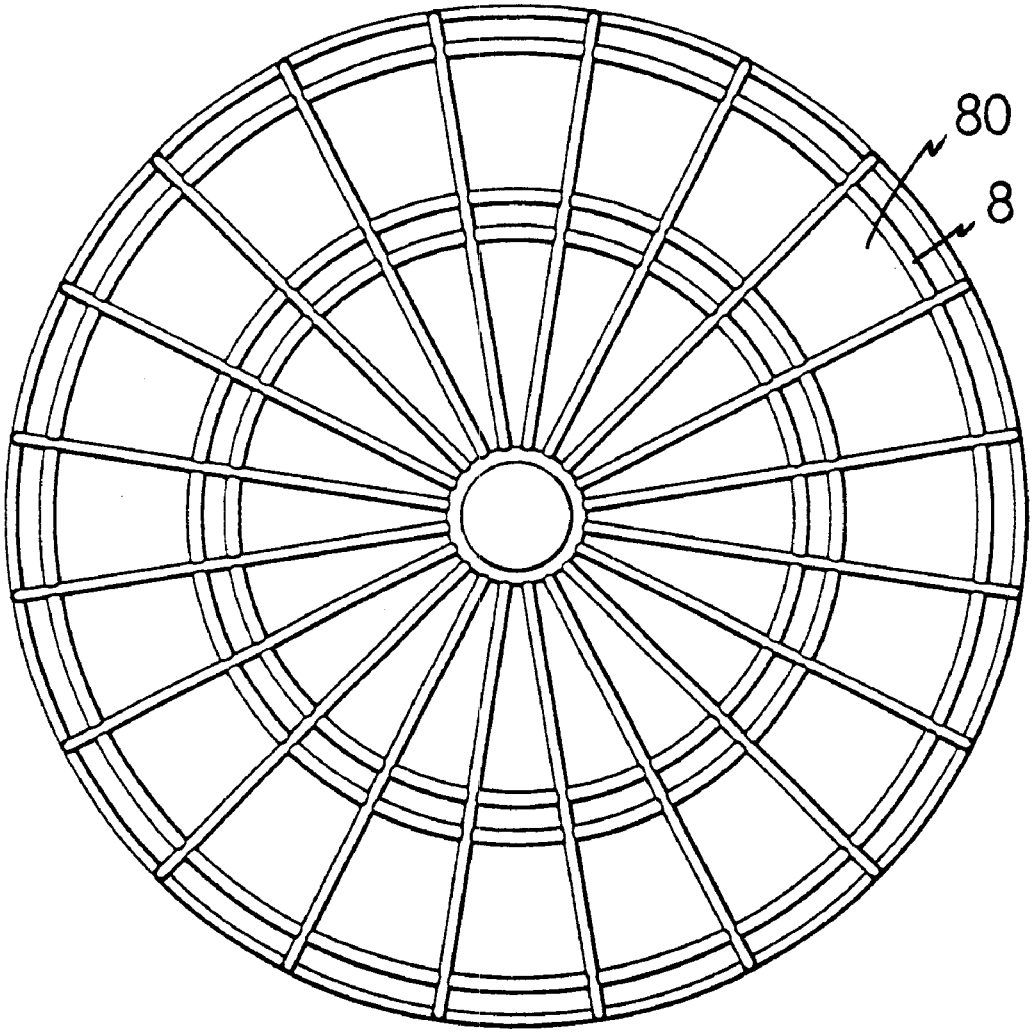
FIG. 6 is a front view to show an embodiment of the frame of the dartboard of the present invention.
Figure 7:
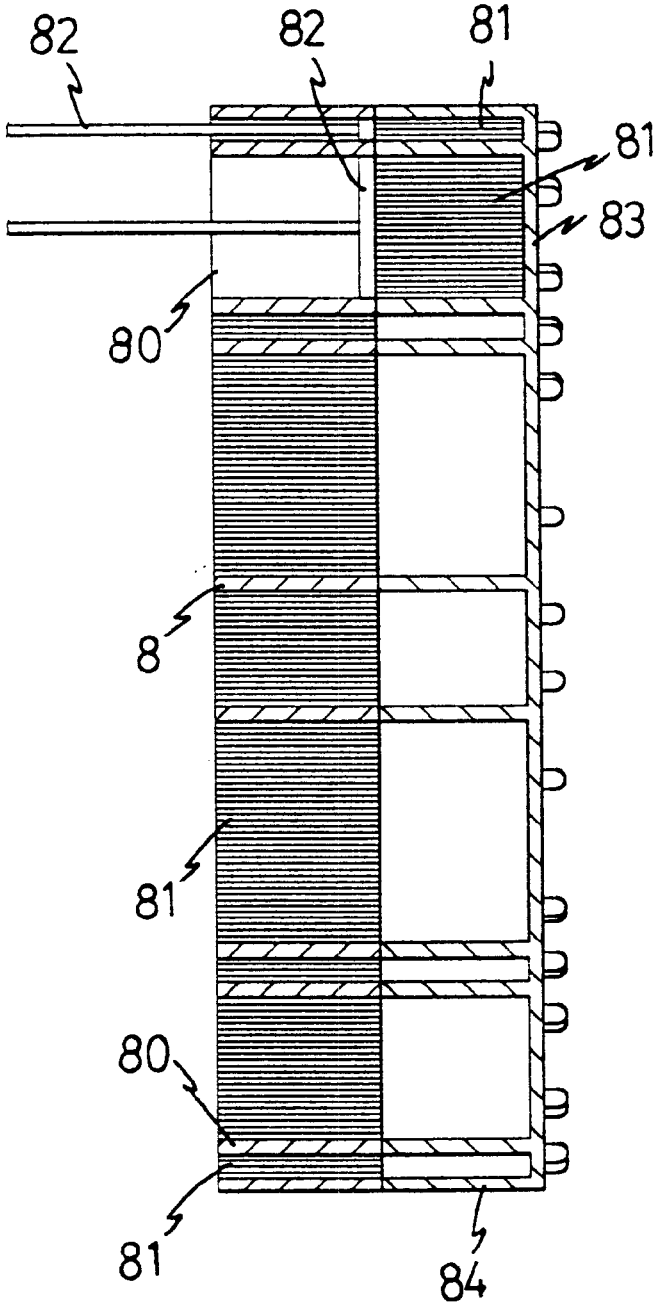
FIG. 7 is a side elevational view, partly in section, of the dartboard having a frame as shown in FIG. 6, wherein the pieces of the heat-fusible block can be pushed toward the board of the frame by a tool.

FIGS. 6 and 7 show another embodiment of the dartboard, wherein the frame is separated into partitions 80 by ribs 8. A plurality of bosses extend from the board 83 of the frame and a peripheral wall 84 extends from the board 83. The pieces of the heat-fusible block 81 are enclosed in the partitions 80. The depth of the each partition 80 is larger than thickness of the piece of the heat-fusible block 81 so that a tool 82 is used to push the piece of the heat-fusible block 81 to a desired position within the partition 80.

In this embodiment, the contact surface of each piece of the heat-fusible block 81 may not located in alignment with each other. This makes the dart game involve more fun.

While we have shown and described various embodiments in accordance with the present invention, it should be clear to those skilled in the art that further embodiments may be made without departing from the scope and spirit of the present invention.

What is claimed is:

1. A dartboard comprising:

a main frame having supporting frames, and a plurality of heat-conductive frames each having a board and a peripheral wall extending from said board so as to define a space, said heat-conductive frames movably engaged with said main frame and separated by said supporting frames, a plurality of bosses extending from each of said boards and a film located adjacent to said bosses and connected to a circuit board, a plurality of separating ribs extending from each of said boards and said peripheral wall of each of said boards, a heat-conductive layer attached to an inside of each of said heat-conductive frames and an outside of each of said separating ribs, said heat-conductive layer heatable to proper temperature for cutting into a heat-fusible block composed of a plurality of strips connected with each other, a piece of said heat-fusible block enclosed in each of said heat-conductive frames after said heat fusible block is cut.

2. The dartboard as claimed in claim 1, wherein each of said separating ribs has a tapered surface.

3. The dartboard as claimed in claim 1, wherein a depth from a distal edge of said peripheral wall to said board of each of said heat-conductive frames is larger than a thickness of said heat-fusible block.

* * * * *